United States Patent [19]

Lorenz

[11] Patent Number: 5,060,851

[45] Date of Patent: Oct. 29, 1991

[54] INTERLOCKING CONTAINER FOR CARRY-OUT FOOD PRODUCTS

[75] Inventor: Achim R. Lorenz, Marietta, Ga.

[73] Assignee: MacMillan Bloedel Containers, Atlanta, Ga.

[21] Appl. No.: 248,988

[22] Filed: Sep. 26, 1988

[51] Int. Cl.[5] ..... B65D 21/00; B65D 43/03

[52] U.S. Cl. ..... 229/125.29; 229/901; 220/4.24

[58] Field of Search ..... 229/125.29, 114, 901, 229/125.28, 23 BT, 125.19, 148, 153, 146; 220/4.21, 4.24

[56] References Cited

U.S. PATENT DOCUMENTS

| | | | |
|---|---|---|---|
| 1,948,322 | 2/1934 | Walsh | 229/153 |
| 2,316,457 | 4/1943 | Royce | 229/901 |
| 2,435,355 | 2/1948 | Inagram, Sr. | 229/23 BT |
| 3,027,062 | 3/1962 | Huss et al. | 229/901 |
| 3,565,146 | 2/1971 | Arnolds | 220/4.24 X |
| 3,902,540 | 9/1975 | Commisso | 220/4.24 |
| 3,926,362 | 12/1975 | Beck et al. | 229/901 |
| 4,187,977 | 2/1980 | Boykin et al. | 229/114 |
| 4,232,816 | 11/1980 | Johnson et al. | 229/146 |
| 4,339,068 | 7/1982 | Brauner | 229/23 BT |
| 4,362,265 | 12/1982 | Williams | 229/901 |
| 4,431,128 | 2/1984 | Dirico | 229/146 |
| 4,444,354 | 4/1984 | Staelgraeve | 229/901 |
| 4,470,538 | 9/1984 | Heathcock et al. | 229/901 |
| 4,474,324 | 10/1984 | Forbes, Jr. | 229/901 |
| 4,804,137 | 2/1989 | Harby | 229/114 |

FOREIGN PATENT DOCUMENTS

| | | | |
|---|---|---|---|
| 2438907 | 2/1976 | Fed. Rep. of Germany | 220/4.24 |

*Primary Examiner*—Stephen Marcus
*Assistant Examiner*—Jes F. Pascal
*Attorney, Agent, or Firm*—Beveridge, DeGrandi & Weilacher

[57] ABSTRACT

A container having a first piece and a complementary second piece closable over the first is disclosed. Each container piece has a bottom wall and sidewalls having central portions which are connected to the bottom wall. Each of a first pair of opposite sidewalls of each piece has an upstanding tab portion extending from the top edge of its central portion. Each of a second pair of opposite sidewalls for each piece includes two spaced-apart upstanding portions for receiving an associated tab portion therebetween to interlock the container pieces. The opposing upstanding portions for each side wall each have a boss portion for engaging a side of the tab portion of a complementary piece.

19 Claims, 2 Drawing Sheets

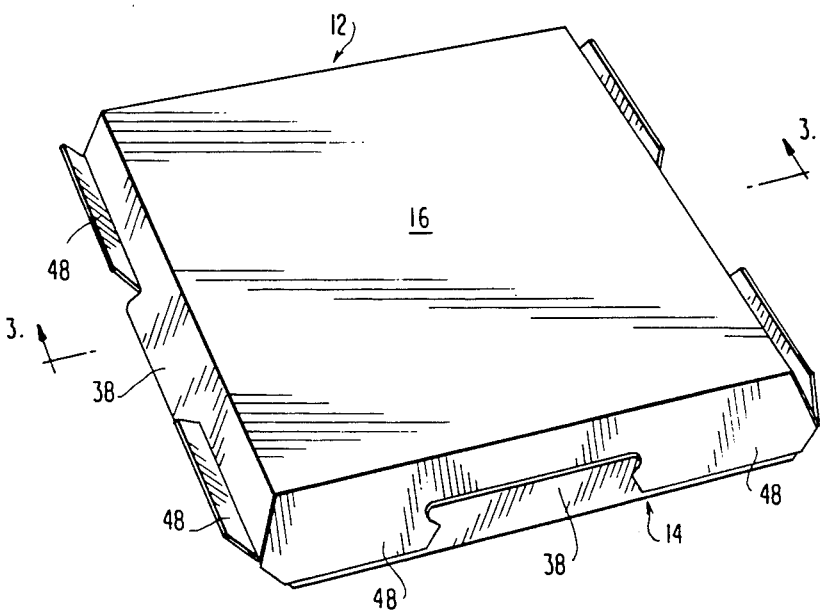
FIG. 3
FIG. 4
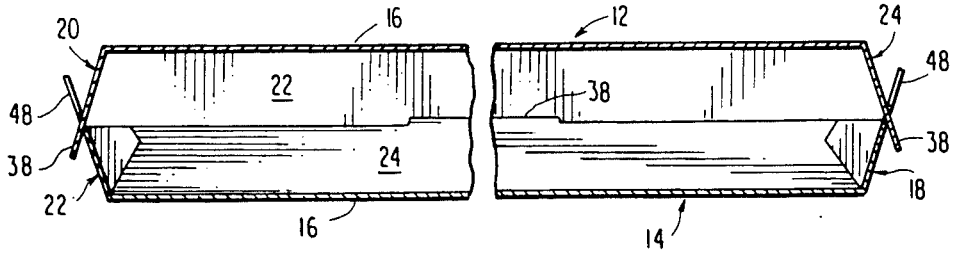
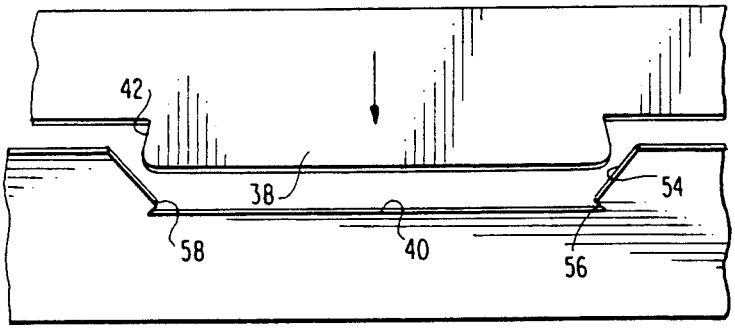
FIG. 5
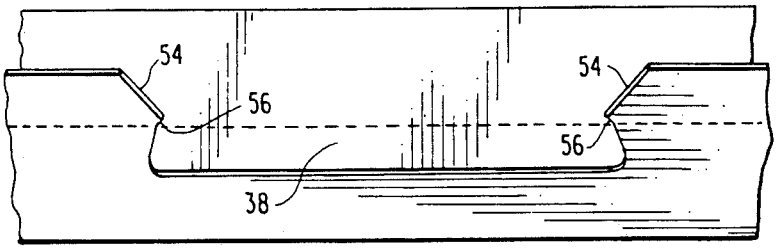
FIG. 6

INTERLOCKING CONTAINER FOR CARRY-OUT FOOD PRODUCTS

BACKGROUND OF THE INVENTION

The present invention pertains to a container suitable for packaging food items such as a pizza for carry-out which container comprises two complementary container pieces, which each have a sidewall provided with an upstanding tab portion and another sidewall, located adjacent the sidewall with the tab portion, provided with locking means formed from opposing boss portions adapted to interlock with the tab portion of a complementary container piece to securely close the container. The present invention also is related to a blank for forming each of the container pieces in accordance with the invention.

In the packaging art, emphasis has been placed on providing suitable containers which are easily stored so as to require minimum storage space, but which are usable immediately. Such a container would be particularly useful in the packaging of relatively large food items such as pizza for carry-out. A known type of container for pizza generally has a relatively large, rectangular bottom wall portion and a top wall portion having the same dimensions as the bottom wall. Four sidewalls are hingeably connected to the bottom wall. One of the sidewalls also hingeably connects the top wall to the bottom wall so that the top wall is provided in the form of a hinged cover for the container.

Other familiar boxes for pizza comprise the telescoping type. Such containers generally have two separate pieces with, one piece telescopically receiving the other piece. Where the pieces are of identical dimensions, the sidewalls could have special fold lines for permitting the covers of the piece which serves as the tray to be pinched inwardly so that the piece serving as the cover can be fitted thereover.

The above-described types of "fold-over" cover and two separate piece pizza boxes must be stored either as flat blanks or in squared-up condition. If flat blanks are stored, the blanks must be squared-up before their use and this increases the effort involved in the preparation of each food product for carry-out. On the other hand, if the boxes are stored in squared-up form, they must be stacked on top of each other and therefore require additional space.

In order to overcome the above-mentioned problems relating to storage of container pieces, nestable containers have been provided. For example, U.S. Pat. No. 3,027,062 discloses a combination tray and cover adapted for interlocking to contain an article. According to the patentee the tray and cover preferably are constructed from blanks of identical size and contour. The six walls of each try and cover piece include, located at the top edge thereof, a locking tab having a male portion delineated by a slit and a guide tab. To interlock the tray and cover, the cover is positioned over the tray so that the locking tabs of the two pieces are placed in contact. The cover is rotated with respect to the tray until the male portions of the locking tabs of each piece, lockingly engage in the slits of the other piece. The means for interlocking the two pieces of U.S. Pat. No. 3,027,062 are somewhat complicated in requiring rotation of the pieces with respect to each other to lock the two pieces together.

U.S. Pat. No. 4,362,265 is another example of a container having top and bottom members which are fabricated from a common blank so that they are reversible. Each tray is provided with a pair of upstanding, opposed end walls of one height and adjacent, upstanding, opposed sidewalls having a lower height. The trays are oriented with their openings facing and are rotated 90 degrees with respect to each other so that when they are brought together, the taller end walls of one tray overlap and telescope over the shorter end walls of the other piece.

U.S. Pat. No. 4,474,324 is a carton of the telescoping type wherein a cover piece fits over a tray piece. The common blank for forming each of the cover and tray pieces is provided with additional score lines so that the corners of the tray piece can be "pinched" together to permit the cover piece to slide over the sidewalls of the tray piece. Both U.S. Pat. Nos. 4,362,265 and 4,474,324 lack very reliable means for interlocking the identical container pieces to prevent accidental opening of the container.

In U.S. Pat. No. 4,444,354 there is shown yet another tray and telescoping cover formed from similar blanks. Still other containers and food cartons are shown in U.S. Pat. Nos. 3,926,362; 4,431,128; 4,339,068; and 4,470,538.

SUMMARY OF THE INVENTION

The container according to the present invention comprises two complementary container pieces, a tray piece and a cover piece which is closable over the tray. The container of the instant invention is particularly suited for enclosing food items, and in particular, relatively large, flat, food items such as a pizza for example. Accordingly, each of the two complementary pieces has a plurality of sidewalls having a relatively small area as compared to the relatively large perimeter bottom wall to which they are hingeably attached.

The sidewalls have central portions. Each complementary piece has a first pair of opposing sidewalls with each sidewall of the first pair including a tab portion extending upwardly from a central portion. Each sidewall of a second pair of sidewalls includes catch means which project upwardly from the central portions thereof. The catch means comprises opposing boss portions that are adapted to interlock with a tab portion of a complementary piece to securely close the container.

The sidewalls of the complementary pieces taper outwardly from their connection to the bottom wall so that when the complementary pieces are interlocked, the tab portions and the catch means of one piece telescope over the sidewall central portions of the other piece and vice-versa. The tab portions have bottom edges which, when the two complementary container pieces are locked together, contact the boss portions to resist accidental opening of the container. Due to the inherent flexibility of the materials from which the preferred container pieces according to the invention are constructed, this resistance to accidental opening does not hinder authorized opening of the closed container. Indeed, the cover and try can be opened by finger force applied to pull apart the interlocked tab portions and catch means.

The cover and tray pieces according to the present invention are formed from identical blanks. Thus, the pieces are interchangeable. Further, due to the outward tapering of the sidewalls from the bottom walls, the pieces are nestable within each other so that they can be stacked when not in use.

Accordingly, the container of the present invention comprises a first piece and a second piece closable over the first piece to form the container. Each of the pieces includes a bottom wall and upstanding sidewalls connected to the bottom wall. The sidewalls of each piece comprise a first pair of opposite sidewalls with each sidewall of the first pair having a tab portion upstanding from the central portion thereof and a second pair of opposite sidewalls with each sidewall of the second pair having two spaced-apart portions upstanding from the central portion thereof. Each of the spaced-apart upstanding portions includes a boss portion oriented so that on each sidewall they face each other in opposition. The boss portions on one piece are thereby adapted to engage with the tab portion of the other piece.

Likewise, a single container piece adapted to provide a container by interlocking with a complementary such piece or a blank for forming such single container piece comprises a bottom wall and upstanding sidewalls having a central portion connected to the bottom wall. Each sidewall of a first pair of opposite sidewalls has a tab portion upstanding from the central portion thereof. Each sidewall of a second pair of opposite sidewalls has two spaced-apart portions upstanding from the central portion thereof. On each sidewall having the upstanding portions, such portions each forms a boss portion which is oriented so that the boss portion of one upstanding portion faces that of the other in opposition.

BRIEF DESCRIPTION OF THE DRAWINGS

In the drawings:

FIG. 3 is a perspective view of the container of FIG. 1 wherein the cover and try pieces are fully interlocked;

FIG. 4 is an elevated, sectional view along line 3—3 of FIG. 3;

FIG. 5 is a sectional view of the tab portion of the cover piece in alignment with the catch means of the complementary try piece; and FIG. 6 is a view, similar to FIG. 5, of the tab portion of the cover piece and the catch means of the complementary piece in fully interlocked relation.

DETAILED DESCRIPTION OF THE PREFERRED EMBODIMENTS

Figure 2:
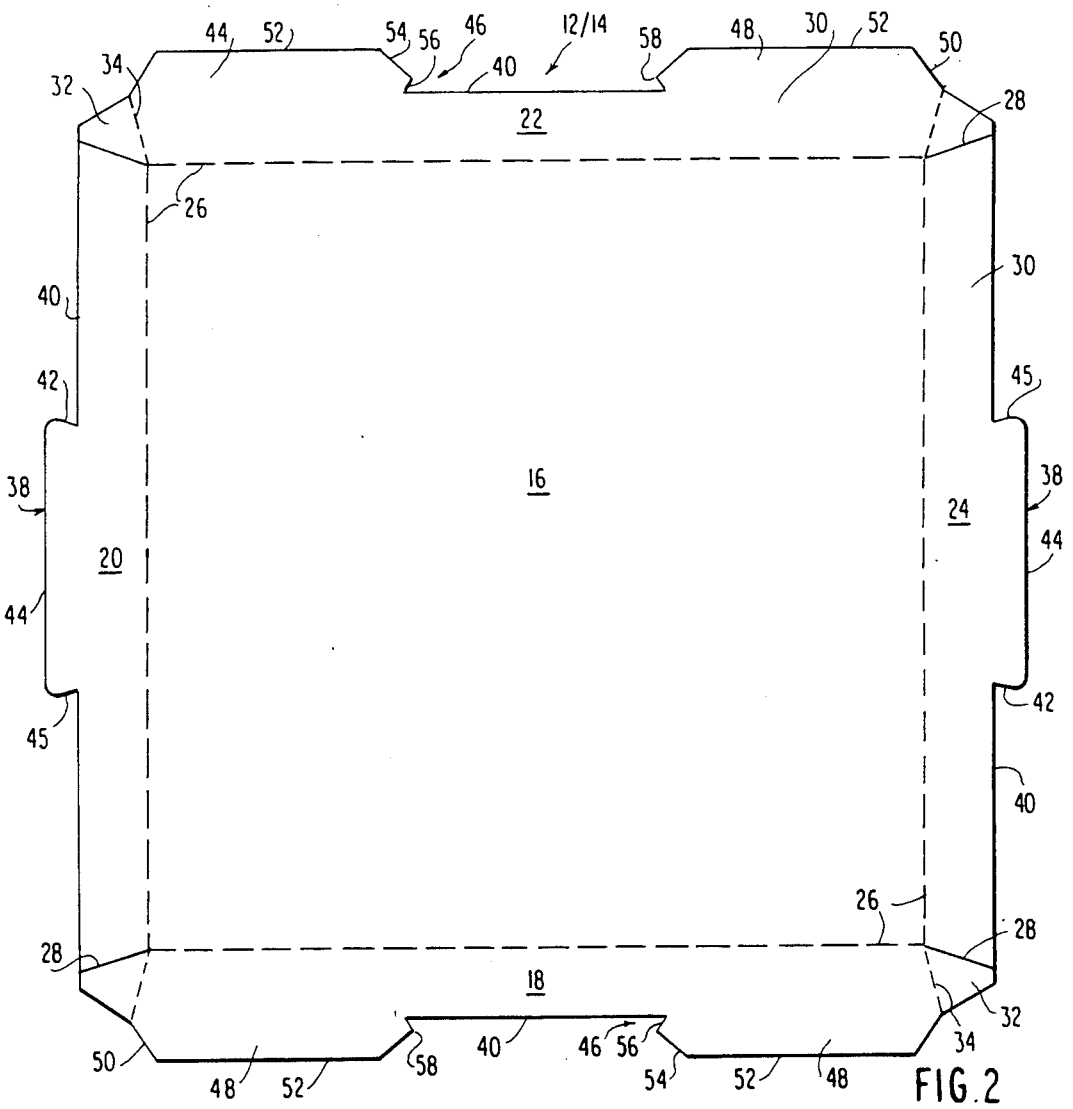
FIG. 2 is a plan view of a blank for forming the two complementary pieces of the container of FIG. 1.

Further aspects and features of the invention will become even more apparent from the following detailed description and drawings wherein like parts are given like reference numerals, and in the appended claims.

Figure 1:
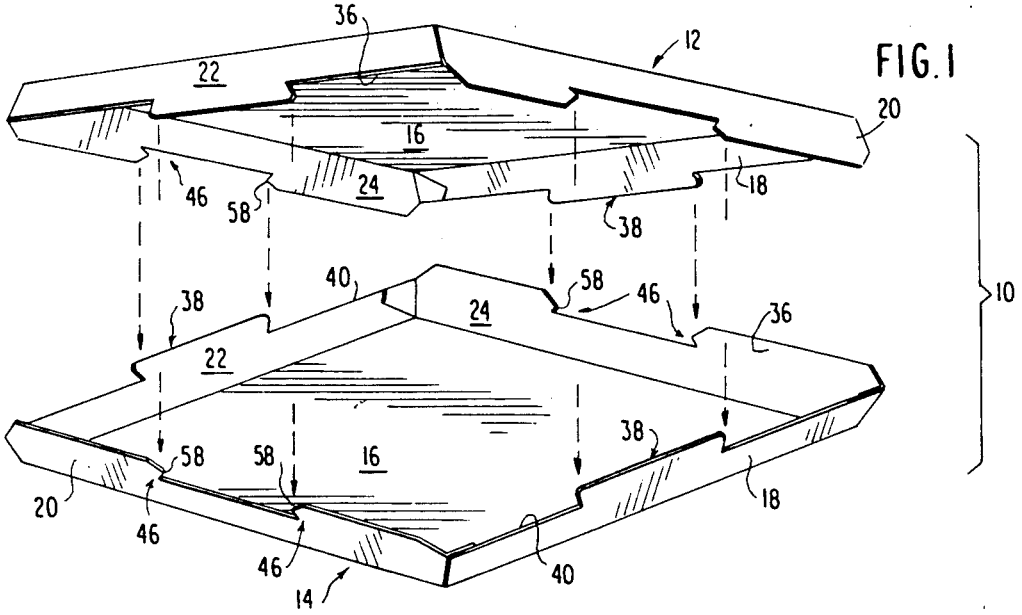
FIG. 1 is a perspective view of a container including a cover piece and a complementary tray piece according to the present invention.

In FIG. 1, there is shown in perspective view, a container 10 according to the present invention. Container 10 is shown as comprising two complementary container pieces 12 and 14, which for convenience, will be referred to hereinafter as cover piece 12 and tray piece 14. Preferably, each complementary piece 12 and 14 of container 10 is formed from a heavy paper board and/or corrugated paper material, which to ensure adequate strength, is provided in a "double-face" arrangement wherein a fluted center sheet is sandwiched between two flat paper board sheets to form the inner and outer surfaces of the pieces. Alternatively, as appreciated by one of ordinary skill in the art, container pieces 12 and 14 could be formed with metal foil, plastic sheet material, foamed plastic or any other well-known material for fabricating containers for food or the like. The selected material should be somewhat flexible and resilient but must provide the requisite strength for protecting the container contents. Configured as shown in FIG. 1, preferred container 10 is suitable for transporting, protecting and thermally insulating large food items. Indeed, container 10 is ideally suited for enclosing a relatively large, flat food item, such as a pizza, and therefore, each complementary container piece 12 and 14 has a relatively large, generally rectangular bottom wall 16 and relatively short sidewalls 18, 20, 22 and 24. Where container 10 is fashioned as a box for carrying pizza, bottom wall 16 might measure 14 inches while the height of the sidewalls 18 through 24 need be only one to two inches.

Both complementary pieces 12 and 14 of preferred container are fabricated from a blank 12/14 having a contour as shown in FIG. 2. Thus, preferred pieces 12 and 14 will have the same size and shape so that they are nestable with each other and can be stacked when not in use. Most preferably, the pieces 12 and 14 are identical and thus can be used interchangeably with either piece serving as the cover or the tray. Further, where the container 10 is, as suggested, dedicated to use for containing food products such as pizzas, the inner and/or outer surfaces of each complementary container piece 12 and 14 can be coated with any conventional coating commonly applied to non-plastic food containers. The coating is of the type for making the paper board and corrugated paper of the container pieces 12 and 14 resistant to the penetration of grease or the like. With such a coating, the pieces can be used to provide serving surfaces for holding food while it is being consumed without the problem of grease penetration.

With reference to FIGS. 1 through 3, sidewalls 18 through 24 are connected to a bottom wall 16 by fold or score lines 26 in a manner well known to those of ordinary skill in the art. Sidewalls 18 and 22 are separated from their adjacent sidewalls 20 and 24 by cut lines 28. Fold and/or score lines 26 and cut lines 28 provide each of sidewalls 18 through 24 with a generally trapezoidally-shaped central portion 30. Opposing sidewalls 18 and 22 are also provided with glue flaps 32 connected by fold or score lines 34 to the central portions 30 thereof.

As apparent to one of ordinary skill in the art, each of complementary container pieces 12 and 14 is formed by "squaring-up" blank 12/14. To square-up blank 12/14, glue flaps 32 are folded upwardly along their fold lines 34. Sidewalls 18 through 24 are folded upwardly with respect to bottom wall 16 along fold and/or score lines 26 whereafter the glue flaps 32 are glued to the inner surfaces of adjacent sidewalls 20 and 24. Any conventional adhesive can be used for squaring-up blank 12/14. Sidewalls 18 through 24 are folded such that fold lines 34, defining the glue flaps 32 come into alignment with cut lines 28. In this way, the sidewalls 18 through 24 of the container pieces 12 and 14 taper outwardly from bottom wall 16 to form an opening or mouth 36 that has a slightly larger perimeter than the bottom wall. Adjacent sidewalls, for instance, sidewalls 18 and 20 of each preferred complementary piece meet at approximately right angles to form the four corners of each container piece 12 or 14.

Sidewalls 20 and 24, which are identical, each have a tab portion 38 that projects upwardly from the top edge 40 of the central portions 30 of those sidewalls, in the plane of such sidewalls. Tab portions 38 have rounded side edges 42 which taper inwardly to intersect the top edge 44 of the tab portion. Side edges 42 form a tapering neck 45 for tab portion 38 which neck is widest near top edge 44 and narrows somewhat to its connection with the central portion 30. Preferably, tab portions 38 are centered on the upper edges 40 of sidewalls 20 and 24 so that each sidewall 20 and 24 is symmetric.

Rather than a tab portion 38, identical sidewalls 18 and 22 each have a catch means, generally identified by reference numeral 46. It is to be understood that, irrespective of the number of sidewalls of each matching container piece, sidewalls 18 and 22 having catch means 46, are located adjacent the sidewalls having tab portions 38 so that the tab portions of one piece can be aligned with the catch means of the complementary piece. Catch means 46 is formed by two spaced-apart upstanding portions 48 which project from the upper edge 40 of sidewalls 18 and 20. Upstanding portions 48 like the tab portions 38 project upwardly from the top edges 40 in the plane of the central portions 30 so that each of sidewalls 18 and 20 is symmetric. Upstanding portions 48 also have a generally trapezoidal shape.

Each upstanding portion 48 has a tapering outer edge 50 which is intersected by the fold or score line 34 to delineate glue flaps 32 from the sidewall central portions 30. The outer edge 50 tapers inwardly to intersect an upper edge 52 of the upstanding portions 48, which edge 52 is generally parallel to the upper edge 40 of the central portion 30. Edges 52 intersect with downward, inwardly-sloping edges 54 which hereinafter will be referred to as guide edges 54. The downward, inwardly-sloping edges 54 lead to downward, outwardly-sloping edges 56 (hereinafter referred to as locking edges 56) which in turn connect the opposing guide edges 54 to the central portion upper edge 40 to form inwardly-projecting, opposing V-shaped corners or bosses 58. Preferably, bosses 58 are spaced-apart along upper edge 40 by a distance substantially equal to the width of tab portion neck 45 where the neck connects with the central portion 30 of sidewalls 20 and 24. While the sloping edges 54 and 56 forming each boss 58 are shown as intersecting at a generally sharp angle, the bosses could have different contours and provide the same function. For instance, the bosses could be "rounded off."

With reference to FIGS. 1 and 3 through 6, to close container 10 after the desired contents have been placed on the tray 14, cover 12 is positioned over the tray with their respective openings 36 facing. Then, the cover 12 is oriented 90 degrees with respect to the tray 14 so that, as shown in FIG. 3, sidewalls 20 and 24 are located immediately above sidewalls 18 and 22 of the complementary container piece. In particular, the tab portions 38 of cover piece 12 are oriented generally to be in alignment with the guide edges 54 of complementary tray piece 14 and vice versa. Thereafter, all that is needed is to press the tray and cover pieces 12 and 14 together as indicated by the direction arrow in FIG. 5. Thus, it is seen that closing of container 10 is facilitated as compared to the arrangements disclosed in U.S. Pat. No. 3,027,062 where the two container pieces must be brought together and then rather carefully rotated with respect to each other to lock the pieces together or U.S. Pat. Nos. 4,339,068; 4,431,128; or 4,470,538 wherein a tab must be inserted through a slot in a sidewall to lock the container. As the complementary pieces 12 and 14 are pressed together by hand pressure, each tab portion 38 is guided into a locking position by the guide edges 54. Since the narrowest region of the tab portion neck 45 is about the same as the spacing between bosses 58, the tab portion 38 just fits between upstanding portions 48. Once the tab portions 38 are pushed past the bosses 58, the side edges 42 of each tab portion contact the locking edges 56. The slope of the locking edges 56 ensures that the tab portions 38 of the complementary pieces remain interlocked in their associated catch means to prevent accidental separation of the container pieces. Tab portions 38 and upstanding portions 48 extend upwardly within the plane determined by their respective sidewalls, beyond their central portions and therefore the tab portions and the upstanding portions of one piece will telescope over the central portions of the complementary piece as seen from FIGS. 3 and 4. As also best appreciated from FIG. 3, outward edges 50 of the upstanding portions 48 slope upwardly from fold or score lines 34 to their intersection with upper edge 52 so as to form generally smoother, beveled corners.

As would be apparent to one of ordinary skill in the art, sidewalls 20 and 24 could be provided with two, spaced-apart tab portions. Accordingly, sidewalls 18 and 22 would have three correspondingly-spaced upstanding portions 48 to receive the tab portions therebetween. The container pieces could be provided with as many tab portions and corresponding upstanding portions as desired.

Once complementary container pieces 12 and 14 have been locked together after enclosure of the desired contents, the edges 42 of tab portions 38 and bosses 58 come into abutment to prevent accidental opening of the container. In their interlocked position, tab portion edges 42 and locking edges 56 resist inadvertent separation of the complementary container pieces. This resistance will not be so substantial as to prevent authorized opening of container 10 due to the flexibility of the materials from which the preferred cover and tray pieces 12 and 14 are fabricated. When it is desired to open container 10, this may be done easily by applying finger pressure to separate tab portions 38 and catch means 46 to open the container. Once the container 10 is opened for removal of the contents, each complementary piece can provide a serving tray for holding the food while it is being consumed. Where the pieces 12 and 14 have been coated with a conventional grease or fluid-resistant coating,. penetration of grease through the pieces will be prevented. Also, due to the flexible nature of the material forming the container pieces 12 and 14, preferably paper board and corrugated paper, the complementary pieces may be opened and closed a number of times without destruction of the tabs 38 and the catch means 46 so that a portion of the contents can be removed from the container and the container can be closed again to keep the remaining food warm.

The container 10 of the present invention is suitable for packaging many different items and in particular food items served for carry-out. The complementary tray and cover pieces 12 and 14 are easily pressed together to close the container. Once the pieces are interlocked, they resist accidental separation to ensure protection of the packaged contents until it is desired to open container 10. Articles such as pizzas or other foods commonly served at carry-out restaurants are readily packageable in the container according to the present invention.

It is to be understood that the complementary tray and cover pieces of the container according to the present invention need not be of a generally square cross-section as shown in the figures but could be of other shapes as well. There are various changes and modifications which may be made by one of ordinary skill in the art, but such changes and/or modifications still would result in a container well within the scope of the invention as set forth in the claims.

What is claimed is:

1. A container comprising a first piece and a second piece closable over said first piece to form said container, each of said pieces including a bottom wall and upstanding sidewalls having a central portion connected to said bottom wall, said sidewalls of each piece comprising:

a first pair of opposite sidewalls with each sidewall of said first pair having a tab portion upstanding from said central portion thereof, and a second pair of opposite sidewalls with each sidewall of said second pair having two spaced-apart portions upstanding from said central portion thereof for receiving an associated tab portion therebetween to interlock said container pieces, said spaced-apart upstanding portions each including a boss portion oriented so that said boss portions on each sidewall face each other in opposition and project towards each other, said boss portions of one piece engaging with said tab portions of the other piece.

2. A container as claimed in claim 1, wherein said tab portions comprise a tapering neck portion, said upstanding portions being spaced-apart corresponding to a width of said neck portion.

3. A container as claimed in claim 2, wherein said facing boss portions are spaced-apart corresponding to a minimum width of said tapering neck portion of said tab portion.

4. A container as claimed in claim 3, wherein said boss portions comprise substantially straight guide edges which intersect with substantially straight locking edges.

5. A container as claimed in claim 4, wherein said upstanding portions of each of said second pair of opposite sidewalls are spaced-apart along the upper edge of their respective central portion, and wherein said guide edges slope downwardly and inwardly with respect to said upper edge and said locking edges slope downwardly and outwardly with respect to said upper edge to connect said guide edges to said upper edge, said guide edges and said locking edges meeting to form each said boss portion to have a V-shape.

6. A container as claimed in claim 1, wherein each complementary container piece is generally rectangular, each of said central portions of said sidewalls being generally trapezoidal.

7. A container as claimed in claim 1, wherein said first and second container pieces are identical, said pieces being nestable.

8. A container piece adapted to form a container by interlocking with another similar, complementary piece, said piece comprising:

a bottom wall and upstanding sidewalls having a central portion connected to said bottom wall, said sidewalls comprising a first pair of opposite sidewalls with each sidewall of said first pair having a tab portion upstanding from said central portion thereof, and a second pair of opposite sidewalls with each sidewall of said second pair having two spaced-part portions upstanding from said central portion thereof, said spaced-apart portions being adapted to receive an associated tab portion of a similar complementary container piece therebetween, said spaced-apart portions each including a boss portion oriented to face the other boss portion on the same sidewall in opposition, said boss portions projecting towards each other whereby they are adapted to engage a tab portion of a similar complementary container piece.

9. A container piece as claimed in claim 8, wherein said tab portions comprise a tapering neck portion, said upstanding portions being spaced-apart corresponding to a width of said neck portion.

10. A container piece as claimed in claim 9, wherein said facing boss portions are spaced-apart corresponding to a minimum width of said tapering neck portion of said tab portion.

11. A container piece as claimed in claim 10, wherein said boss portions comprise substantially straight guide edges which intersect with substantially straight locking edges.

12. A container piece as claimed in claim 11, wherein said upstanding portions of each of said second pair of opposite sidewalls are spaced-apart along the upper edge of their respective central portion, and wherein said guide edges slope downwardly and inwardly with respect to said upper edge and said locking edges slope downwardly and outwardly with respect to said upper edge to connect said guide edges to said upper edge, said guide edges and said locking edges meeting to form each said boss portion to have a V-shape.

13. A container piece as claimed in claim 8, wherein said piece is generally rectangular, each of said central portions of said sidewalls being generally trapezoidal.

14. A blank for forming a container piece, said blank comprising:

a bottom wall and sidewall portions adapted to extend upwardly from said bottom wall, said sidewall portions each having a central portion connected to said bottom wall, said sidewall portions each comprising a first pair of opposite sidewall portions with each portion of said first pair having a tab portion adapted to extend upwardly from said central portion thereof, and a second pair of opposite sidewall portions with each portion of said second pair having two spaced-apart portions adapted to extend upwardly from said central portion thereof, said spaced-apart portions further being adapted to receive an associated tab portion of a complementary container piece formed from a similar blank, said spaced-apart portions each including a boss portion oriented so that said boss portions on each sidewall portion face each other in opposition and project towards each other.

15. A blank as claimed in claim 14, wherein said tab portions comprise a tapering neck portion, said spaced-apart portions being spaced-apart corresponding to a width of said neck portion.

16. A blank as claimed in claim 15, wherein said facing boss portions are spaced-apart corresponding to a minimum width of said tapering neck portion of said tab portion.

17. A blank as claimed in claim 16, wherein said boss portions comprise substantially straight guide edges which intersect with substantially straight locking edges.

18. A blank as claimed in claim 17, wherein said spaced-apart portions of each of said second pair of opposite sidewall portions are spaced-apart along the upper edge of their respective central portion, and wherein said guide edges slope downwardly and inwardly with respect to said upper edge and said locking edges slope downwardly and outwardly with respect to said upper edge to connect said guide edges to said upper edge, said guide edges and said locking edges meeting to form each said boss portion to have a V-shape.

19. A blank as claimed in claim 14, wherein each of said central portions of said sidewall portions are generally trapezoidal.

* * * * *